US005632469A

United States Patent [19]

Heun et al.

[11] Patent Number: 5,632,469

[45] Date of Patent: May 27, 1997

[54] ELECTRIC HOIST WITH SPEED CONTROL, A PROTECTIVE HOUSING AND A SWIVELABLE CIRCUIT BOARD IN THE HOUSING

[75] Inventors: Jürgen Heun, Dortmund; Holger Freitag, Bochum; Anton Müller, Wetter; Anton Münzebrock, Dortmund, all of Germany

[73] Assignee: Mannesmann Aktiengesellschaft, Dusseldorf, Germany

[21] Appl. No.: 529,015

[22] Filed: Sep. 15, 1995

[30] Foreign Application Priority Data

Sep. 15, 1994 [DE] Germany ..... 44 34 373.6

[51] Int. Cl.[6] ..... B66D 1/48

[52] U.S. Cl. ..... 254/267; 254/276; 254/362

[58] Field of Search ..... 254/362, 360, 254/267, 276, 372, 275

[56] References Cited

U.S. PATENT DOCUMENTS 4,580,640 4/1986 Boldt ..... 254/276 X 4,636,962 1/1987 Broyden et al. ..... 254/276 X 4,789,135 12/1988 Watanabe ..... 254/362

4,917,360 4/1990 Kojima ..... 254/362

FOREIGN PATENT DOCUMENTS 0529120 3/1993 European Pat. Off. .

*Primary Examiner*—Daniel P. Stodola

*Assistant Examiner*—Emmanuel M. Marcelo

*Attorney, Agent, or Firm*—Cohen, Pontani, Lieberman, Pavane

[57] ABSTRACT

An electric hoist with motor-speed-regulated lifting speed, in particular an electric chain hoist, including an electric motor, a gear unit, and a wheel around which the hoisting chain is looped. A load-carrying device is arranged on the hoisting chain. The motor, gear unit and wheel are connected with one another in a drive connection and the lifting speed is provided by an electric control unit for the electric motor, which control unit is connected to a manual control switch. In order to achieve suitable cooling while apportioning the space in an appropriate manner for the arrangement of all required components, the electric control unit, which has control electronics with speed sensing equipment, is arranged in an external protective housing fitted to the gear box.

10 Claims, 2 Drawing Sheets

ELECTRIC HOIST WITH SPEED CONTROL, A PROTECTIVE HOUSING AND A SWIVELABLE CIRCUIT BOARD IN THE HOUSING

BACKGROUND OF THE INVENTION

1. Field of the Invention

The invention is directed to an electric hoist with a lifting speed that is motor-speed-regulated. More particularly, the invention relates to an electric chain hoist, in which an electric motor, a gear unit, a wheel around which hoisting means are looped, the hoisting means, and load-carrying means are connected with one another in a drive connection. An electric control unit is provided for the electric motor and is connected to a manual control switch.

2. Discussion of the Prior Art

Electric chain hoists of the above-mentioned type are used with hoisting mechanisms which are driven by an electric motor and use a link chain as carrying means, primarily for vertical transportation of loads.

The electrical energy is switched directly from the power supply for the motor by the manual control switch mentioned above or is controlled via contactors (motor switches). In the latter case, a suitable number of pairs of motor switches which are installed in a protected manner at the chain hoist are associated with the electric control in addition to the manual control switch. Electric (chain) hoists generally have a single speed for lifting and lowering the load corresponding to the nominal speed of the motor and the selected gear reduction. In special applications, a second, slower speed is required. In such cases, a pole-changeable motor is selected which has an additional winding for the second motor speed and is switched by additional switches of the electric control unit. The range of application of electric (chain) hoists and the convenience of operation could be substantially improved if the speed, i.e., the motor speed, could be changed continuously between very small values and the nominal speed. This is enabled in a known manner by means of a static frequency converter which transforms the fixed line or mains frequency determining the speed into a rotating field with variably controllable frequency for the motor. Such an arrangement is disclosed in EP 0529120 A1.

In this arrangement the frequency converter control replaces the electromechanical motor switches mentioned above. In so doing, the problem arises that the location for mounting the motor switch is not suitable for receiving a frequency converter or there is not sufficient space available in this location. In particular, losses must be guided off as heat and, further, it is necessary to provide means for measuring speed with appropriate accuracy.

SUMMARY OF THE INVENTION

Accordingly, it is an object of the present invention to provide an electric chain hoist with motor-speed-regulated lifting speed in which it is possible to install control electronics and a speed measuring device in a simple and space-saving manner and, in so doing, to guide off heat losses to a sufficient extent.

Proceeding from the electric hoist with motor-speed-regulated lifting speed mentioned above, this object is met according to the invention in that the electric control unit, which has control electronics with speed sensing equipment, is arranged in an external protective housing fitted to the gear box. Accordingly, it is possible to install the control electronics and speed sensing equipment in a simple and compact manner and at the same time to guide off heat losses adequately.

In so doing, the protective housing is advantageously formed as a cup-shaped hood. The required space is made available in this way, since the protective housing fits ideally to the rest of the structural components of the housing, thereby resulting in a compact unit.

Further, it is advantageous that the cup-shaped hood is formed of a material with good thermal conductivity, which helps to guide off heat. The desired heat conduction can be assisted in an advantageous manner by attaching a carrier for the heat generated by a power semiconductor of a frequency converter inside of the base of the cup.

To additionally aide the guiding off of heat, the inner side of the protective housing is provided with a black surface to improve heat transfer.

According to further embodiment of the invention, the desired utilization of space is aided in that a shaft end of the gear unit or electric motor projects into a lower casing between the protective housing and the gear box. A pulse wheel of the sensory equipment is arranged on this shaft end in a stationary manner. The pulse wheel can rotate at the speed of the motor or at an only slightly reduced speed and, e.g., can be formed as a magnet ring and a corresponding number of north and south poles for a magnetic sensor, or as a marked disk for an optical sensor.

The allotment and utilization of space is effected in such a way that an electronic printed circuit board is installed in the lower casing and can be swiveled out around a hinge fastened in the lower casing or in the gear box after removing the protective housing. This not only advantageously improves accessibility to the electronic printed circuit board after the protective housing has been removed, but also provides access to the pulse wheel. This arrangement can be constructed so that the sensing unit of the sensory equipment is fastened to the swivelable printed circuit board and the pulse wheel is attached opposite the latter on the gear shaft or motor shaft.

The distinctive characteristics of the arrangement of the sensory equipment entailed in this allotment of space are made possible and balanced in that a centering pin is arranged and fastened at the same distance to the gear shaft or motor shaft so as to pass through the lower casing and the printed circuit board for the purpose of an exact positioning of the sensing unit. Therefore, an exact distance between the pulse wheel and the sensing unit can be achieved via the centering pin when the printed circuit board is swiveled in.

The housing of the compact unit of the electric hoist which is closed for the required protection against dust can now be extensively cooled by a fan that is arranged on the shaft end of the electric motor opposite the shaft end of the sensory equipment so as to be fixed with respect to rotation relative thereto and since the protective housing, lower casing, gear box, and electric motor housing are closed outwardly, forming interior spaces which are interconnected in the interior. The flow of cooling air generated by the fan is therefore guided out of the protective housing through the electric motor, gear unit, sensory equipment and converter unit.

According to an additional embodiment of the invention, the components for processing the control command from the manual control switch, the speed detection, the speed regulation of the electric motor, and the control of the frequency converter are arranged on the printed circuit board. Furthermore, the frequency converter installed in the protective housing is connected to the power supply, electric motor and printed circuit board via line connections.

A further embodiment of the invention includes seals inserted between the protective housing and the lower casing and around the line through-opening. These seals ensure that the frequency converter, the speed sensor equipment, the gear unit, the electric motor and other component parts are protected.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
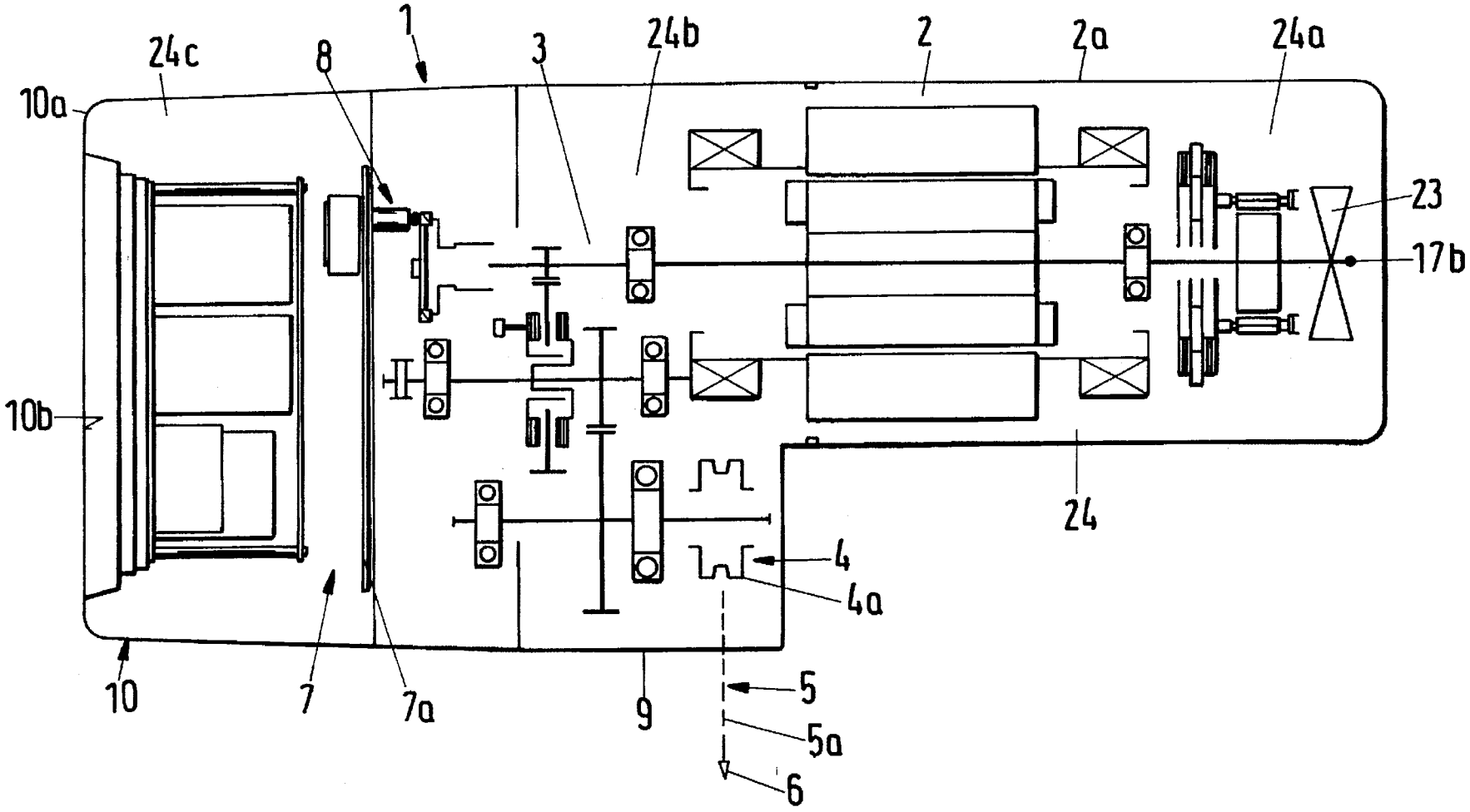
FIG. 1 is an axial section through the entire unit of the electric hoist pursuant to the present invention.

The electric hoist with motor-speed-regulated lifting speed pursuant to the present invention is shown in the preferred embodiment as an electric chain hoist 1. An electric motor 2 with an electric motor housing 2*a*, and a gear unit 3 which can have a plurality of gear steps comprise the main portions of the electric hoist 1. Two gear steps with toothed wheels are shown in the illustrated embodiment. The last gear step has a chain wheel 4*a* as a wheel 4. The hoisting means 5 are formed by a chain 5*a* to which load-carrying means 6 are fastened, e.g., a crane hook, a lower block, and the like.

An electric control unit 7 which has control electronics 7*a* operated by a manual control switch 26 serves to regulate the motor speed and accordingly the lifting speed. The electric control 7 further includes speed sensor equipment 8 with a pulse wheel 8*a* which is arranged on a gear shaft or motor shaft 17 in the embodiment illustrated in FIG. 2. The sensor equipment 8 also includes a sensing unit 8*b*. The pulse wheel 8*a* is either a circumferential magnet ring with a corresponding number of north and south poles for a magnetic sensor or a marked disk for an optical sensor. The speed sensor equipment 8 is arranged, together with the control electronics 7*a*, in a protective housing 10 connected to a gear box 9 and is accordingly favorably accessible to cooling.

For this purpose, the protective housing 10 has the form of a cup-shaped hood 10*a*. The cooling can be effected, for instance, by means of a favorably heat-conducting material or by cooling slots, i.e., based on the principle of heat flow and/or heat conduction. For cooling heat due to energy losses of a power semiconductor 13 of a frequency converter 14, a carrier 12 for the semiconductor 13 is advantageously accommodated on an inner side 11 of the base 10*b* of the cup-shaped hood 10*a*. The inner side 11 of the protective housing 10 is provided with a black surface 15 to improve the heat transfer.

A shaft end 17*a* of the gear unit 3 or electric motor 2 projects into a lower casing 16 between the protective housing 10 and the gear box 9. The pulse wheel 8*a* of the sensory equipment 8 is arranged on this shaft end 17*a* so as to be fixed with respect to rotation relative thereto.

An electronic printed circuit board 19 is installed in the lower casing 16. After removing the protective housing 10, this printed circuit board 19 can be swiveled outward around a hinge 20 after loosening oppositely located screws for the purpose of improved accessibility and access to the pulse wheel 8*a*. The sensory equipment 8 is arranged in such a way that the sensing unit 8*b* of the sensory equipment 8 is fastened on the swivelable printed circuit board 19 and the pulse wheel 8*a* is attached across from it on the gear shaft or motor shaft 17.

The exact positioning of the sensing unit 8*b* maintained in this way is achieved by a centering pin 21 which extends at the same distance 22 parallel to the gear shaft or motor shaft 17 through the lower casing 16 and through the printed circuit board 19 and is fastened in this position by a screw.

Cooling can also be carried out by circulation of cooling air. For this purpose, a fan 23 is arranged on shaft end 17*b* of the electric motor 2 opposite the shaft end 17*a* so as to be fixed with respect to rotation relative thereto. The cooling air flow of the fan 23 is guided through the interior space 24*a* of the electric motor 2, the interior space 24*b* of the gear box 9, and the interior space 24*c* of the lower casing and protective housing 10, these interior spaces being closed outwardly and interconnected as the interior 24 of the hoist. Cooling air slots, not shown in more detail, are arranged at the end of the protective housing 10.

Figure 2:
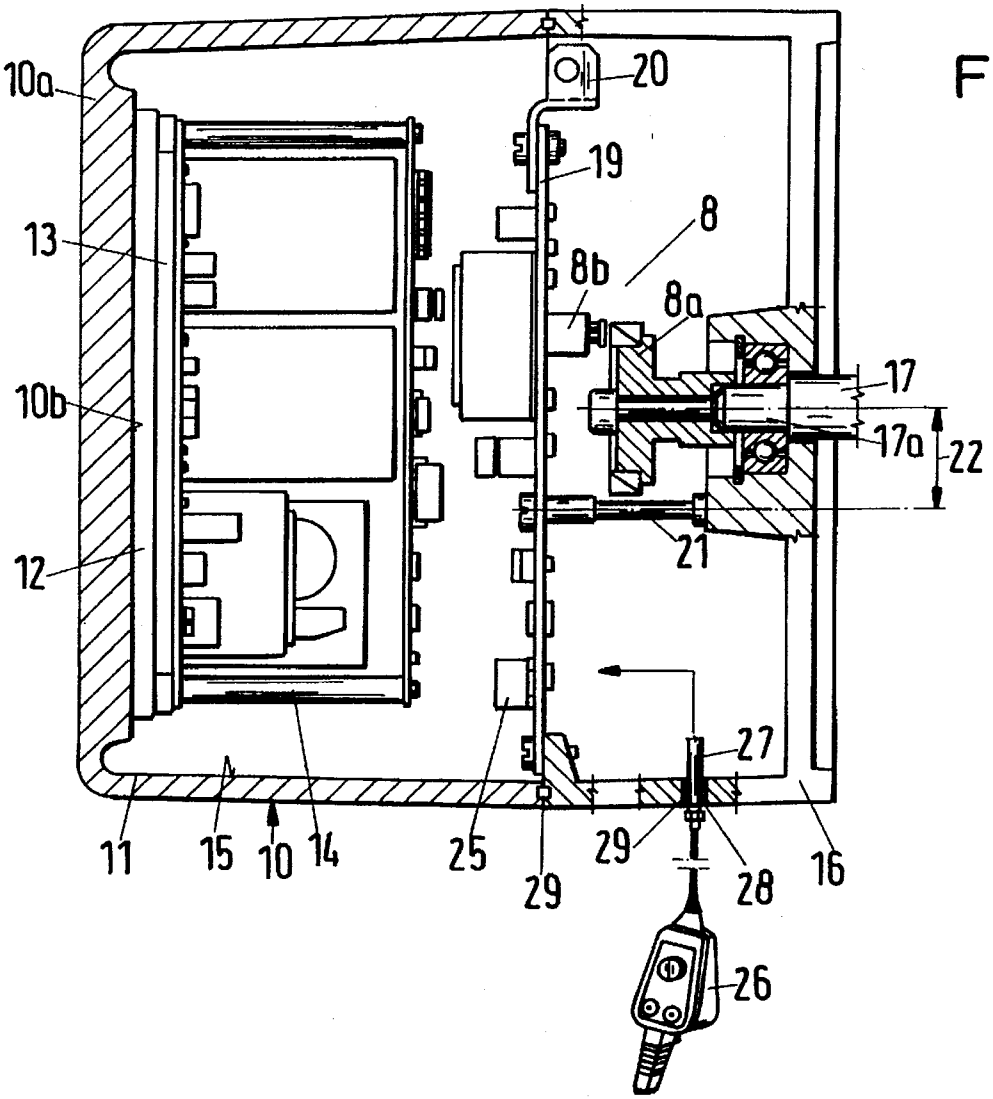
FIG. 2 is an enlarged partial section of the protective housing with the lower casing and with the manual control switch.

As can be seen in FIG. 2, components 25 for processing the control command from the manual control switch 26, the speed detector, the speed regulator of the electric motor 2 and for the control of the frequency converter 14, are arranged on the printed circuit board 19 in the protective housing 10.

The frequency converter 14 installed in the protective housing 10 is connected to the power supply, the electric motor 2 and the printed circuit board 19 via line connections 27. Seals 29 are inserted between the protective housing 10 and lower casing 16 and around the line through-opening 28 to prevent dirt or other contaminants from entering the casing.

The invention is not limited by the embodiments described above which are presented as examples only but can be modified in various ways within the scope of protection defined by the appended patent claims.

I claim:

1. An electric hoist with a motor-speed-regulated lifting speed, comprising:

an electric motor;

a gear unit;

hoisting means for hoisting a load;

a wheel around which the hoisting means is looped;

load carrying means connected to the hoisting means for engaging the load, the electric motor, the gear unit, the wheel, the hoisting means and the load carrying means are connected with one another in a drive connection;

electronic control means for controlling the electric motor;

a manual control switch operatively connected with the electric control means;

a gear box in which the gear unit is arranged;

an external protective housing removably attached to the gear box, the electronic control means including control electronics and speed sensing equipment and being arranged in the external protective housing, the protective housing having an inner side with a base;

a frequency converter having a power semiconductor, and a carrier for the semiconductor attached to the inner side of the base;

a lower casing arranged between the protective housing and the gear box, one of the gear unit and the electric motor having a shaft with a shaft end arranged to project into the lower casing, the speed sensing equipment including a pulse wheel fixed on the shaft end that projects into the lower casing;

a hinge fastened in one of the lower casing and the gear box; and, an electronic printed circuit board mounted to the hinge so as to be arranged in the lower casing and further so as to be swivelable out about the hinge when the protective housing is removed from the gear box.

2. An electric hoist according to claim 1, wherein the protective housing is made of a material with good thermal conductivity.

3. An electric hoist according to claim 1, wherein the protective housing has an inner side with a black surface to improve heat transfer.

4. An electric hoist according to claim 1, wherein the speed sensing equipment includes a sensing unit fastened to the swivelable printed circuit board so as to be opposite the pulse wheel.

5. An electric hoist according to claim 4, and further comprising a centering pin arranged to pass through the lower casing and the printed circuit board at a uniform distance to one of the gear shaft and the motor shaft so as to maintain the sensing trait in an exact position.

6. An electric hoist according to claim 1, and further comprising an electric motor housing, the protective housing, the lower casing, the gear box, and the electric motor housing being connected together and outwardly closed so as to form interconnected interior spaces and still further comprising a fan rotatably fixed on an end of the shaft of the electric motor opposite the shaft end on which the pulse wheel is fixed.

7. An electric hoist according to claim 1, and comprising components arranged on the printed circuit board so as to be operative to process a control command from the manual control switch, speed detection, speed regulation of the electric motor, and control of the frequency converter.

8. An electric hoist according to claim 1, and further comprising line connections provided to connect the frequency converter to the electric motor and the printed circuit board, the frequency converter also being connectable to a power supply by the line connections.

9. An electric hoist according to claim 8, wherein a through-opening is provided in one of the housing and the lower casing through which through-opening the line connection passes, and further comprising seal means inserted between the protective housing and the lower casing and around the through-opening for sealing the housing and the casing.

10. An electric hoist according to claim 1, wherein the hoisting means includes a chain.

* * * * *